US010774717B2

(12) United States Patent
Richardson

(10) Patent No.: US 10,774,717 B2
(45) Date of Patent: Sep. 15, 2020

(54) STRUCTURES FOR CATALYTIC CONVERTERS

(71) Applicant: Imagine TF, LLC, Campbell, CA (US)

(72) Inventor: Brian Edward Richardson, Los Gatos, CA (US)

(73) Assignee: Imagine TF, LLC, Los Gatos, CA (US)

( * ) Notice: Subject to any disclaimer, the term of this patent is extended or adjusted under 35 U.S.C. 154(b) by 0 days.

(21) Appl. No.: 16/172,732

(22) Filed: Oct. 27, 2018

(65) Prior Publication Data

US 2019/0128168 A1 May 2, 2019

Related U.S. Application Data

(60) Provisional application No. 62/708,589, filed on Dec. 14, 2017, provisional application No. 62/707,424, filed on Nov. 1, 2017.

(51) Int. Cl.
*F01N 3/28* (2006.01)
*F01N 13/18* (2010.01)

(52) U.S. Cl.
CPC ..... *F01N 3/2842* (2013.01); *F01N 3/2807* (2013.01); *F01N 3/2825* (2013.01); *F01N 13/1888* (2013.01); *F01N 2330/02* (2013.01); *F01N 2330/06* (2013.01); *F01N 2330/38* (2013.01)

(58) Field of Classification Search
CPC . F01N 3/2842; F01N 13/1888; F01N 2330/02
USPC ..... 422/177, 180; 55/523
See application file for complete search history.

(56) References Cited

U.S. PATENT DOCUMENTS 3,649,213 A * 3/1972 De Palma ..... F01N 3/2846 422/176
2010/0319314 A1* 12/2010 Noller ..... F01N 3/2839 60/272

* cited by examiner

*Primary Examiner* — Tom P Duong
(74) *Attorney, Agent, or Firm* — Keith Kline; The Kline Law Firm PC

(57) ABSTRACT

Various structures for catalytic convertors are disclosed herein. The device includes an outer housing enclosing a catalytic core. The catalytic core can be formed in a myriad of ways. Flow paths through the core are constructed so that they are not straight-line paths from the inlet of the device to the outlet of the device. Zigzag conformations and stacked panel arrays are described that maximize the catalytic surface area in a given volume of housing.

10 Claims, 24 Drawing Sheets

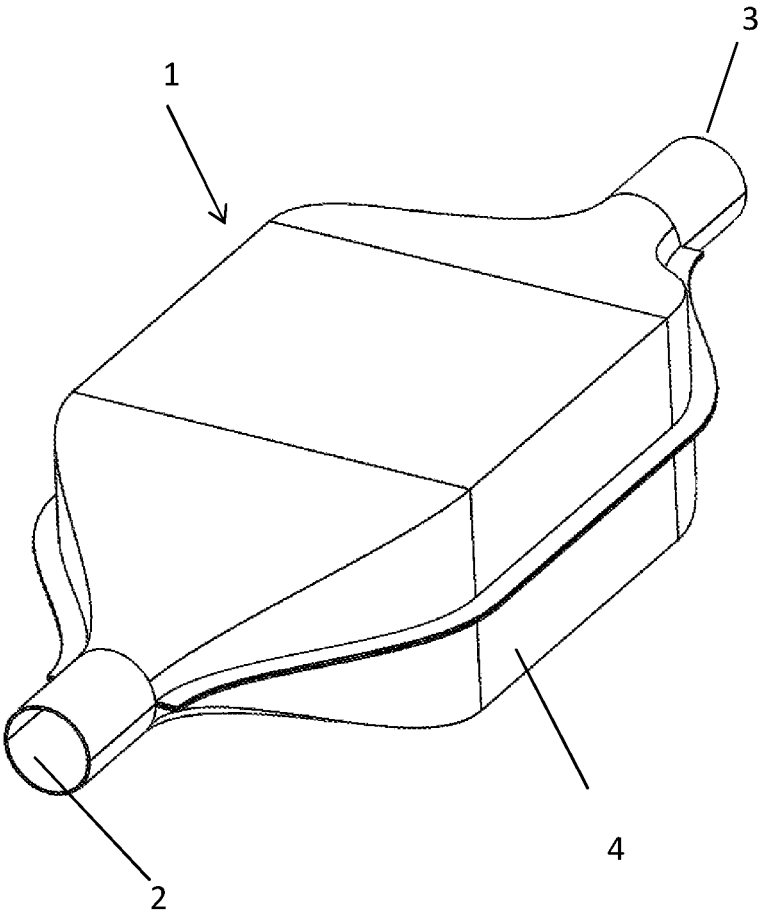
*Fig. 1, Prior Art*

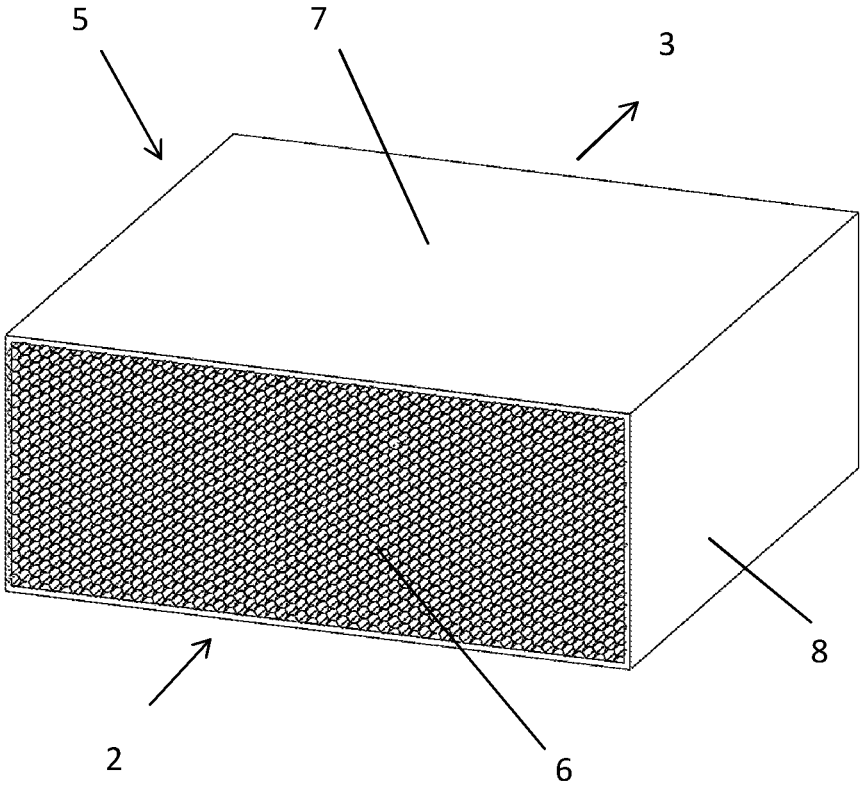
*Fig. 2, Prior Art*

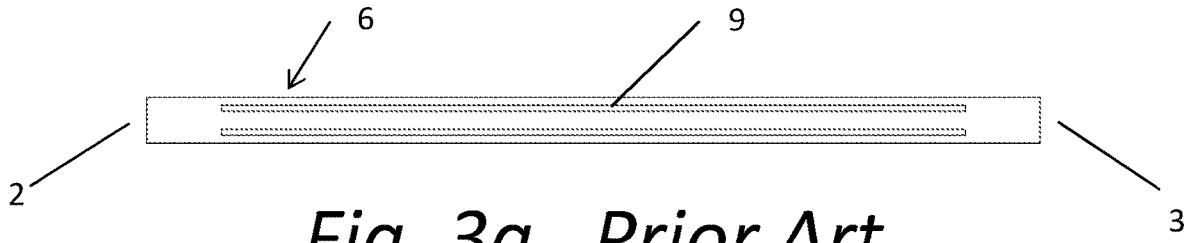
Fig. 3a , Prior Art
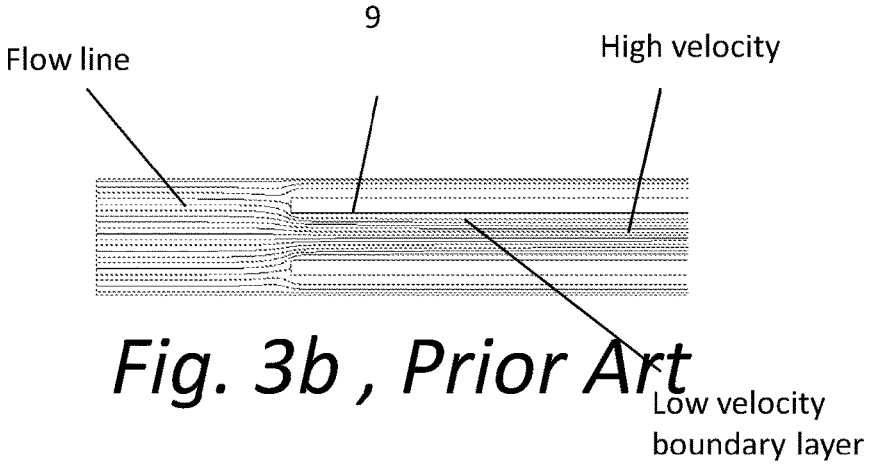
Fig. 3b , Prior Art
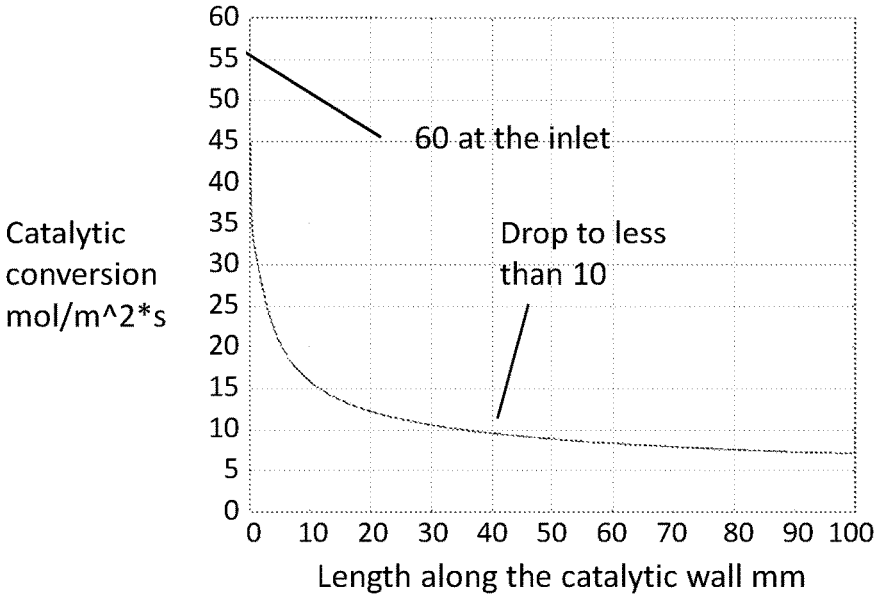
Fig. 3c , Prior Art

STRUCTURES FOR CATALYTIC CONVERTERS

CROSS REFERENCE TO RELATED APPLICATIONS

This application claims the priority benefit of U.S. Provisional Application 62/707,424, filed on Nov. 1, 2017, and the priority benefit of U.S. Provisional Application 62/708,589, filed on Dec. 14, 2017, all of which are hereby incorporated by reference herein in their entireties including all references and appendices cited therein, for all purposes.

FIELD OF THE DISCLOSURE

The present disclosure relates generally to fluidic architectures for the catalytic conversion of exhaust gases from internal combustion engines, and more specifically, but not by way of limitation, to fluidic architectures that provide for efficient catalytic conversion of harmful exhaust gases to gases that are not harmful.

SUMMARY

In various embodiments of the present disclosure, catalytic convertor devices include a housing and a convertor core. The convertor core includes at least one catalytic panel. Both the convertor core and the housing have an inlet side and an outlet side. The convertor core further includes at least one catalytic panel, the catalytic panel having openings that form fluid flow paths. The openings are staggered from the inlet side to the outlet side so that no fluid flow path is a straight line. This maximizes exposure of inlet harmful gases to catalytic surfaces by minimizing a boundary layer and proving configurations that maximize the exposure of virgin harmful gases to catalytic surfaces.

In various embodiments, the convertor core is made from a plurality of catalytic panels that form a catalytic array. Each of the catalytic panels in the array has a plurality of openings therein that form fluid flow paths.

In some embodiments, the convertor core includes at least one catalytic panel having a plurality of openings therein that form fluid flow paths, the catalytic panel being conical in configuration. The conical configuration ensures that the openings are offset from one another so that the fluid flow paths created by the openings are not a straight line from an inlet end of the device to an outlet end of the device.

BRIEF DESCRIPTION OF THE DRAWINGS

The accompanying drawings, wherein like reference numerals refer to identical or functionally similar elements throughout the separate views, together with the detailed description below, illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

FIG. 1 is a perspective view of a prior art catalytic converter assembly.

FIG. 2 is a perspective view of a prior art catalytic converter core.

FIGS. 3*a* and 3*b* are more detailed views of the prior art catalytic core illustrated in FIG. 1. FIG. 3*c* shows the results of numerical simulations of a prior art catalytic core such as that shown in FIG. 1.

DETAILED DESCRIPTION

Figure 4:
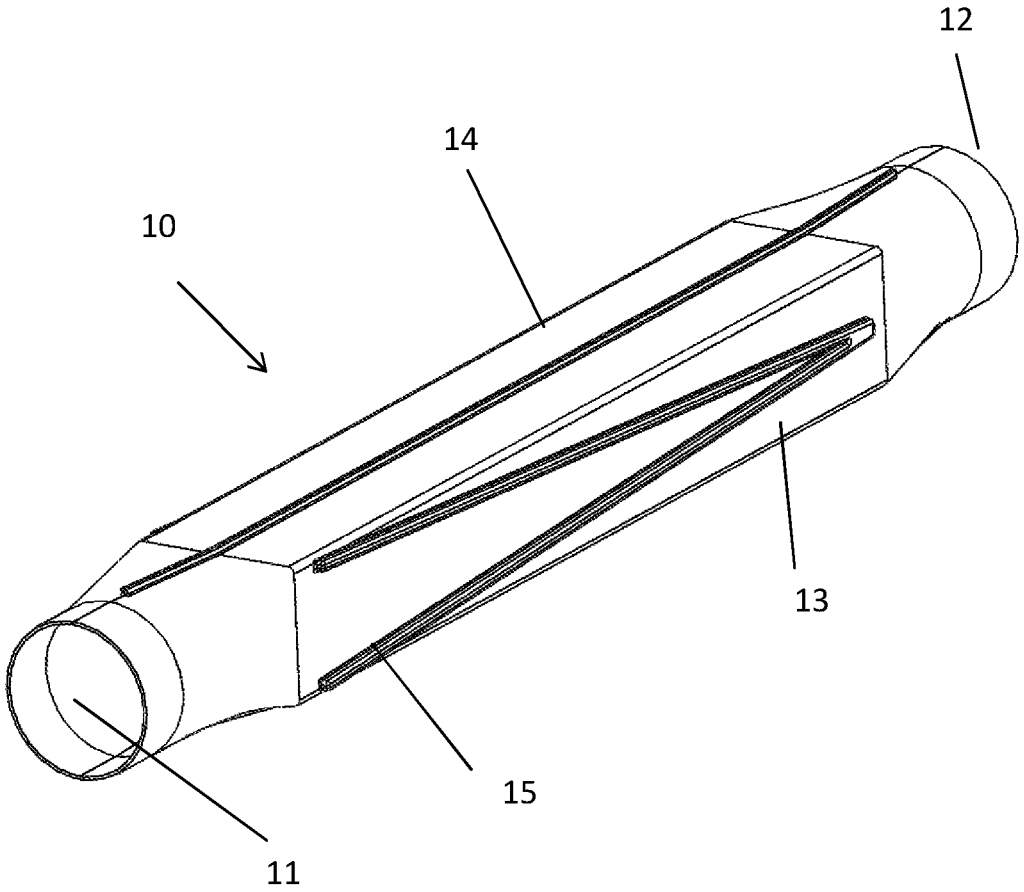
FIG. 4 is a perspective view of a catalytic converter in accordance with one embodiment of the present disclosure.

The present disclosure is generally directed to configurations of catalytic surfaces that are utilized to convert harmful exhaust gases to harmless gases in a more efficient manner and at a lower cost than current art devices. The configurations of catalytic surfaces disclosed herein results in more efficient conversion of harmful exhaust gases to harmless gases both during normal operation and warmup. Catalytic materials are much more efficient at converting harmful gasses at elevated temperatures. The reduced mass and the fluidic architecture disclosed herein results in catalytic convertor devices that require significantly less time to reach efficient conversion temperature. The lower cost of the devices is at least in part the result of a reduction in the mass of the devices and the more efficient utilization of the precious metals used in the devices.

Referring first to FIG. 1, a prior art catalytic converter assembly 1 is shown with an inlet 2 through which exhaust gases from an internal combustion engine enter the catalytic converter assembly 1. Exhaust gases from internal combustion engines typically contain a small amount of gases that are harmful to humans and the environment. When the catalytic converter 1 is cold, the harmful exhaust gases can pass thought the catalytic converter without being converted to harmless gases. The gases exit the catalytic converter assembly 1 at the outlet 3. When the conversion components within the catalytic converter assembly 1 reach operational temperature, a significant fraction of the harmful exhaust gases are converted to harmless gases. The converter housing 4 directs the inlet gases through a catalytic converter core 5. A representative catalytic convertor core 5 is shown in FIG. 2. The interior walls of the converter housing 4 are generally mated with the outside wall of the catalytic converter core 5 to ensure that all of the exhausted gases to be treated pass through the catalytic core 5.

Referring still to FIG. 2, the inlet exhaust gases flow into the convertor assembly 1 at the inlet face 2 of the catalytic core 5. The gases flow into channels 6 and then exit at an outlet 3 side of the catalytic core 5. Nearly all the exhaust gases that flow through the channels 6 are converted from harmful gases to harmless gases (presuming an operable temperature in the catalytic core 5) as the inlet gases react with a catalytic material on the surface of the channels 6. It should be noted that FIG. 2 does not show the channels 6 to scale. The channels 6 would typically be much smaller than they appear to be in FIG. 2. A typical catalytic converter core 5 might be approximately 100 mm wide by 100 mm tall and 100 mm in length. Typically, the channels 6 would be approximately 1 mm wide by 1 mm tall and extend the full length, 100 mm, of the catalytic converter core 5. This high aspect ratio is typically required to meet the conversion performance requirements.

The surfaces of the walls of the catalytic converter core 5 are coated with a material that acts as a catalyst. The catalytic material is typically a precious metal, but other materials known to those in the art may be used as well. The engineering of the specific catalytic material used for catalytic conversion is not discussed herein. One skilled in the art of catalytic conversion materials and their reaction with exhaust gases could apply the art to any of the fluidic structures described in this disclosure.

At high gas flow conditions, the velocity of the inlet gases at the center of the channel might be over 50 meters per second. The harmful gases located at the center of the channel must diffuse sufficiently to contact the channel surfaces to be converted from harmful gases to harmless gases. Because of the high velocity at which they travel through the core 5 and the relatively slow rate of diffusion of the harmful gases, the channels 6 should be configured so that the walls of the channels 6 are a relatively small distance from the center of the channels 6. While these long narrow channels 6 are restrictive to the gas flow, this conformation is essential for proper catalytic conversion. However, the flow restrictive channels 6 lead to reduced engine power and increased fuel consumption. Long narrow channels 6 also require a significant amount of material which includes significant amounts of precious metals.

FIGS. 3*a*, 3*b* and 3*c* illustrate the cross section of a prior art core channel 6. The resultant performance of the convertor is shown graphically in FIG. 3*c*. FIGS. 3*a* and 3*b* (detail views with flow lines) show a side view and cross section of one of the channels 6 in the catalytic converter core 5. Results of a multiphysics numerical analysis simulation of the resultant flow are illustrated in graphical form in FIG. 3*c*. FIG. 3*c* shows the conversion rate at the channel surface 9 as the gases flow down the channel 6. The conversion rate of gases at the inlet end 2 is extremely high in comparison to the conversion rate along the rest of the channel surface 9. At the inlet 2 the channel surface 9 conversion is greater than 60 mol/m$^2$. At the inlet 2 the gas in contact with or in close proximity to the catalytic surface 9 is "virgin" exhaust gas. As the gas flows down the channel 9, the relative concentration of the harmful gases decreases as the harmful gases are converted to harmless gases. The reduced concentration of harmful gases reduces the conversion efficiency of the conversion device. Further, the velocity at the channel surface 9 is slow relative to the velocity at the center of the channel 6 due to the increase in depth of the boundary layer. Therefore the velocity at the center of the channel is very high relative to the velocity at the channel surface. The high velocity at the center of the channel 6 makes it difficult for the harmful gases to diffuse to the channel surface 9. Due to the reduced concentrations and the high velocity at the center of the channel, performance of a catalytic convertor with the illustrated conformation is much less than optimum. The percentage of conversion is maximized under the conditions at the inlet 2 of the convertor core channels 6. The configurations described herein are devised to take advantage of these factors.

Another factor that must be considered in designing a catalytic convertor is that catalytic conversion materials are typically precious metals and therefore can significantly affect the cost of the device. Further, catalytic material must operate at elevated temperatures to be effective. The large mass of current catalytic converters requires a significant amount of time to warm up. During warmup most of the harmful gases pass through the catalytic converter without being converted to harmless gases. The significant warmup required in prior art convertors contributes to much of the smog in urban areas.

Referring now to FIG. 4, one embodiment of a catalytic converter 10 is illustrated. Exhaust gases enter an inlet 11 of the catalytic converter 10 at a first end of the housing and exit through an outlet 12 at a second end of the housing. For ease of manufacturing, the housing may be constructed from two halves, a frontside 13 of the housing and a backside 14 of the housing. The housing may include guide slots 15 to help position internal components. As would be apparent to one skilled in the art, the aspect ratio and configuration of the housing can of course vary greatly according to design considerations of various implementations.

Figure 5:
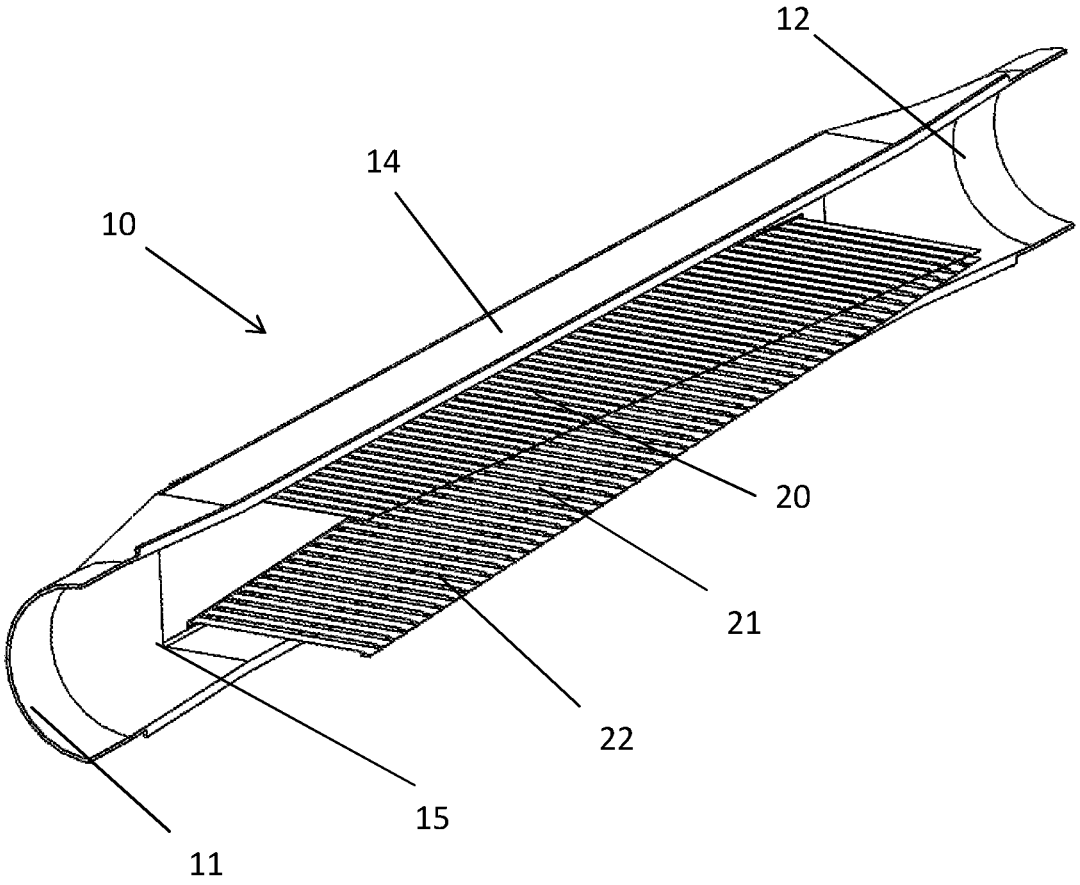
FIG. 5 is a section view of FIG. 4 illustrating the interior components of the catalytic converter depicted in FIG. 4.

FIG. 5 shows the catalytic convertor 10 with the frontside 13 of the housing removed so that the internal components of the catalytic converter 10 can be easily seen. An upper catalytic panel 20 is located above a lower catalytic panel 21. It should be noted that the panels 20, 21 are constructed from a porous material. The structure of the panels 20, 21 will be discussed in greater detail below. The ends of the catalytic panels 20, 21 nearest the inlet 11 are spaced apart from one another. The ends of the catalytic panels 20, 21 nearest the outlet 12 contact or are in close proximity to each other or contact each other so that a "V" shaped configuration of the panels 20, 21 is created. The panels 20, 21 are in contact with the top, bottom, and sides of the housing so that the housing seals the sides of the panels 20, 21 to ensure that all of the exhaust gasses received at the inlet 11 flow through the catalytic panels 20, 21. The positioning of the panels 20, 21 is facilitated by the guide slots 15.

Figure 6:
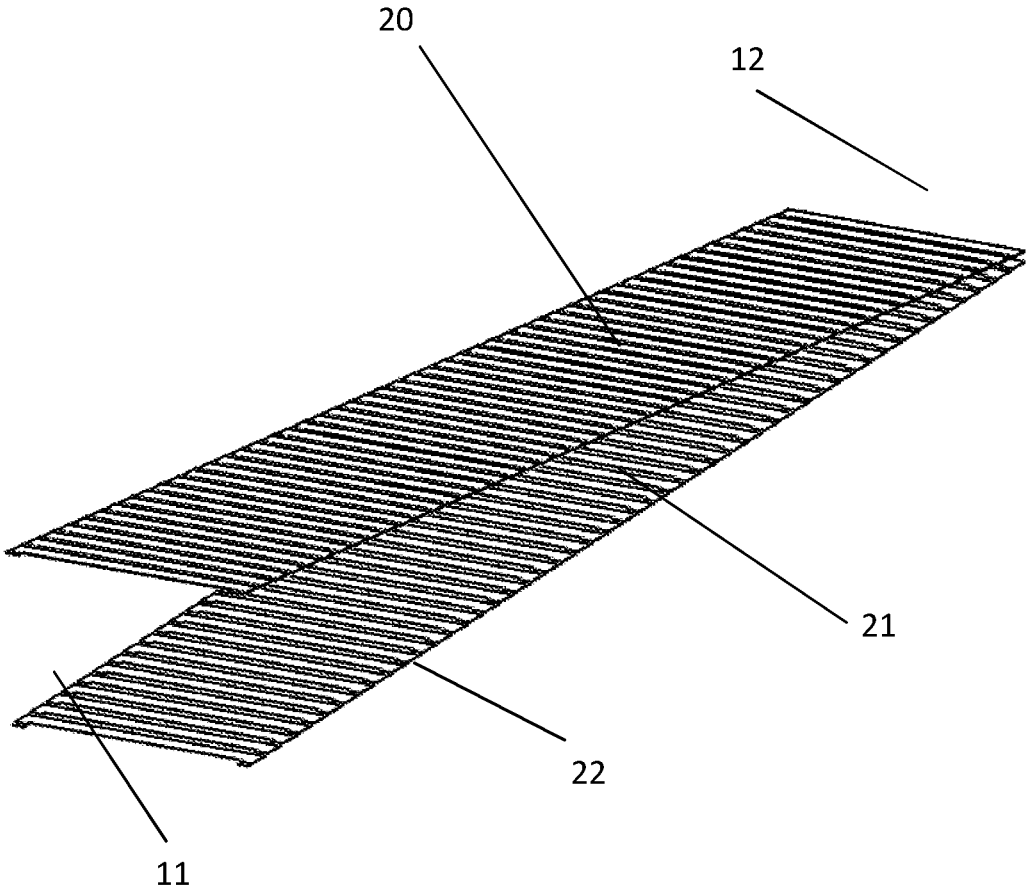
FIG. 6 is a view with the same perspective as FIG. 5 but showing the catalytic panel elements with the housing removed.
Figure 7:
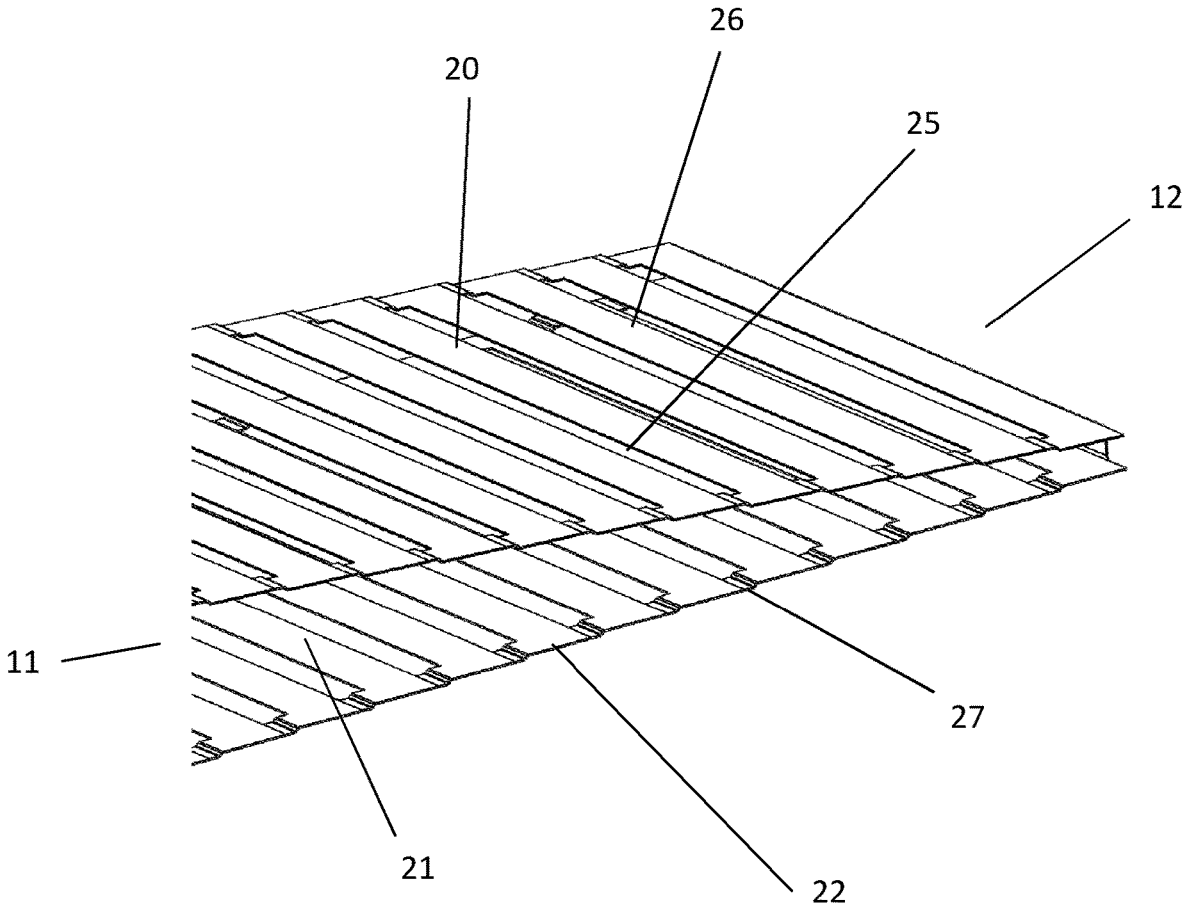
FIG. 7 is a detail view of the outlet end of the catalytic panel elements illustrated in FIG. 6.

FIG. 6 and FIG. 7 show more detailed views of the structure of the catalytic panels 20, 21. In FIG. 7, the openings 25 that maximize fluid flow across the catalytic surfaces can be more clearly seen. The catalytic panels 20, 21 may be constructed with any number of panel sections 26 (typically there will be a large number of the sections 26) spaced apart by the panel openings 25. In many embodiments, the panel sections 26 are approximately equally sized, as are the openings 25. However, it should be noted that simulations have shown that the sizes of the panel sections 26 and of the panel openings 25 can be adjusted slightly as a function of their location in the fluid path to optimize performance. Moreover, should the user desire to employ the catalytic converter to remove particulates from the flow, the size of the openings 25 can be adjusted accordingly.

The spacing and positioning of the panel sections 26 is maintained by the panel connecting members 27. The connecting members 27 can be couplers that are located at the ends of the panel sections 26. The connecting members 27 can be received with the ends of the panel sections 26 in the guide slots 15 in the housing. The panel connecting members 27 are shown at the ends 22 of the catalytic panels. If desired due to structural considerations, additional panel connecting members 27 can be added between adjacent panel sections 26 to increase the overall stiffness of the panels 20, 21.

Figure 8:
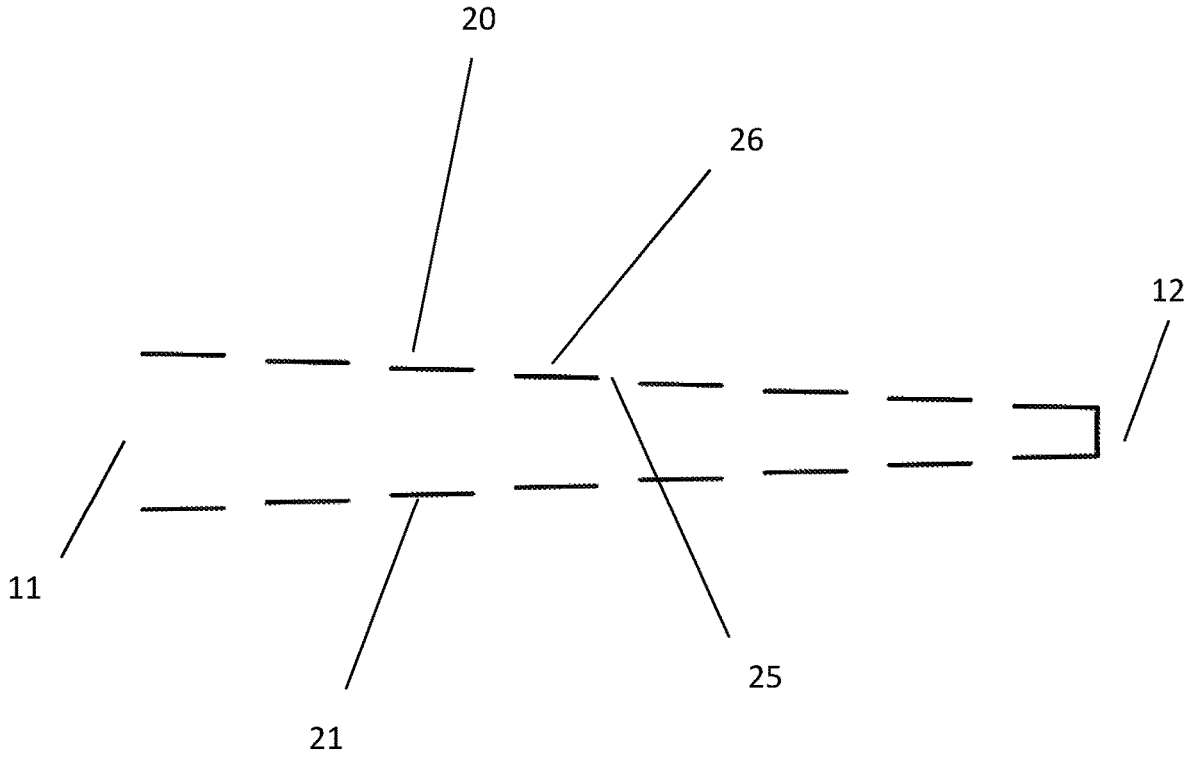
FIG. 8 is a side view of the catalytic element illustrated in FIG. 7.

In some exemplary embodiments, such as that shown in side view in FIG. 8, the surfaces of the panel sections 26 are staggered as in a staircase. Staggering the panel sections 26 helps to optimize the gas flow in various embodiments. With staggered panel section 26, the inlet gas cannot flow in a straight line from the inlet to the outlet.

Figure 9:
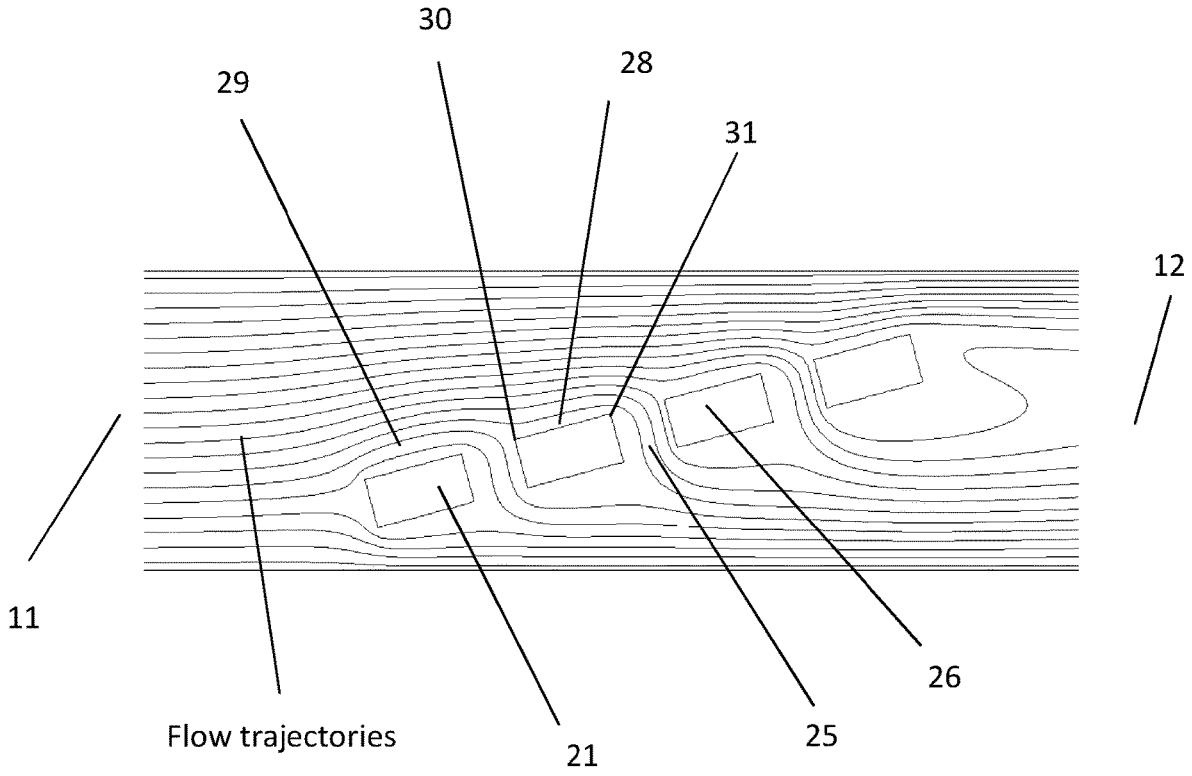
FIG. 9 is a side view similar to FIG. 7 showing the flow trajectories from a multiphysics flow simulation of the process that takes place during catalytic conversion.

FIG. 9 shows traces of the gas flow pattern in an exemplary device. It can be seen that a leading edge 30 and a trailing edge 31 of each of the panel sections 26 disrupts the flow so that it is non-laminar. Exhaust gases flow into the inlet 11 of the catalytic converter 10 at a high velocity. The gas elements that pass in close proximity to any of a plurality of catalytic surfaces 28 have a slower velocity than the main portion of the gas flow. The velocity is reduced as a boundary layer 29 is formed near the catalytic surfaces 28. The reduction of velocity near the catalytic surfaces 28 is conducive to improved conversion efficiency. The alternating configuration of staggered panel sections 26 and panel openings 25 results in a boundary layer 29 with generally a uniform thickness along the surface of the panel sections 26. The boundary layer thickness remains generally uniform because the gases are drawn through the panel openings 25, thereby negating the tendency of the boundary layer 29 to increase in thickness. Continuously removing gas from the boundary layer 29 generates a continuous supply of virgin harmful gases to the catalytic surfaces.

The phenomenon of improving flow patterns by minimizing the boundary layer is similar to the "boundary layer suction" effect that has been experimented with relative to the reduction of aerodynamic drag of aircraft. The Northrop X-21 aircraft was built to test boundary layer suction and its reduction of aerodynamic drag.

Figure 10:
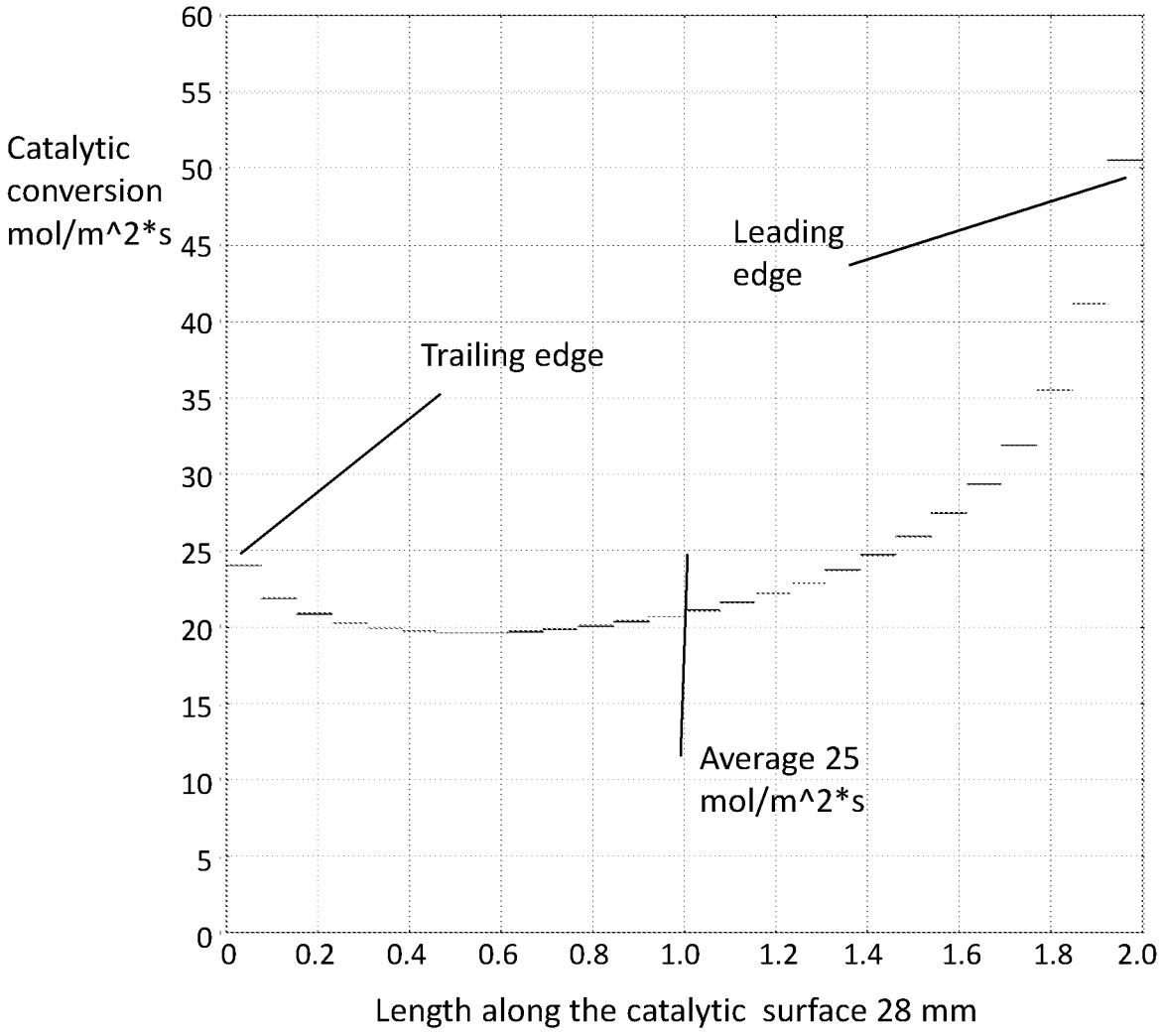
FIG. 10 shows graphical results of the multiphysics flow simulation of the apparatus shown in FIG. 9.

FIG. 10 is a graphical depiction of a multiphysics simulation on an exemplary configuration of a catalytic convertor. The graph shows the conversion of the catalytic surface 28 from the leading edge 30 to the trailing edge 31. It can be seen that conversion of exhaust gases averages approximately 25 mol/m$^2$ and only drops slightly below 20 mol/m$^2$ (Prior art devices typically have rates that drop to less than 10 mol/m$^2$). With the architecture disclosed herein, the catalytic surfaces are always exposed to virgin gasses, the distance harmful gases need to travel to a catalytic surface is small, and all the virgin gases eventually come in close proximity to a catalytic surface 28.

Figure 11A:
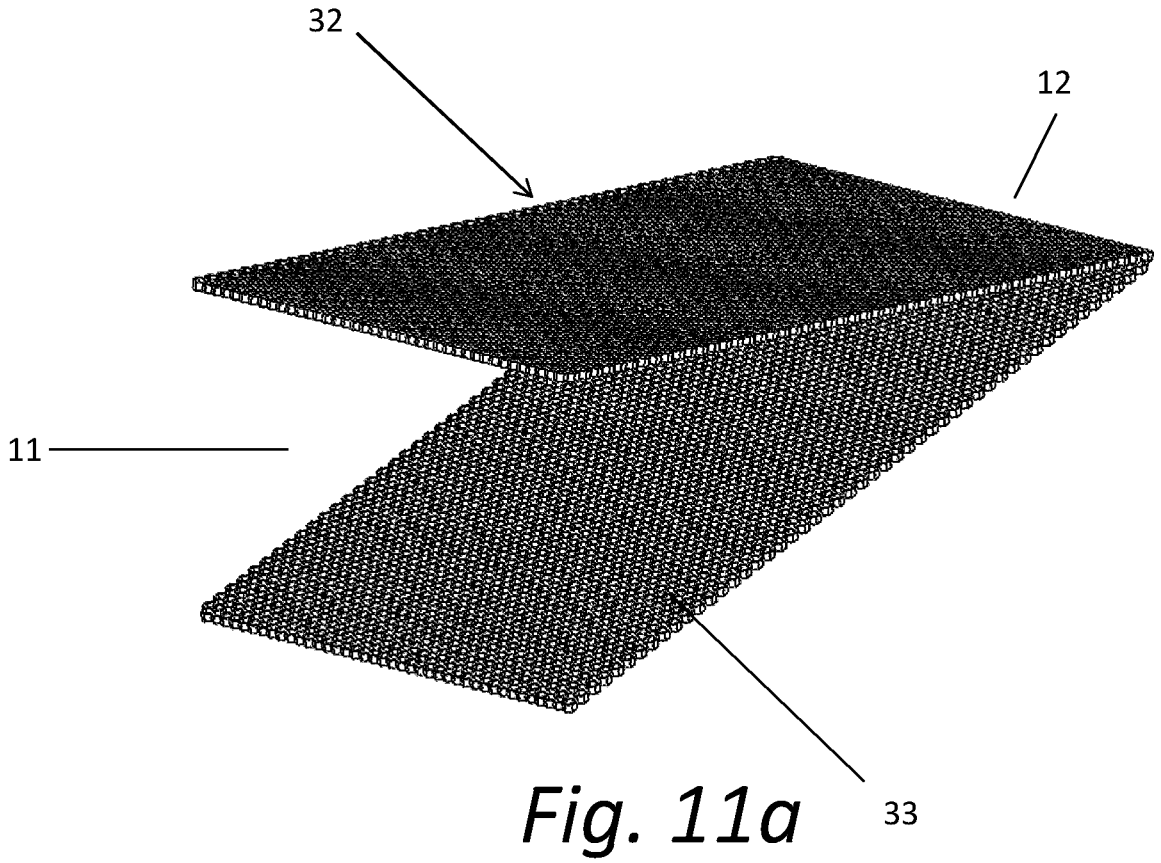
FIGS. 11*a* and 11*b* show an alternate configuration of the catalytic panels illustrated in FIG. 6.
Figure 11B:
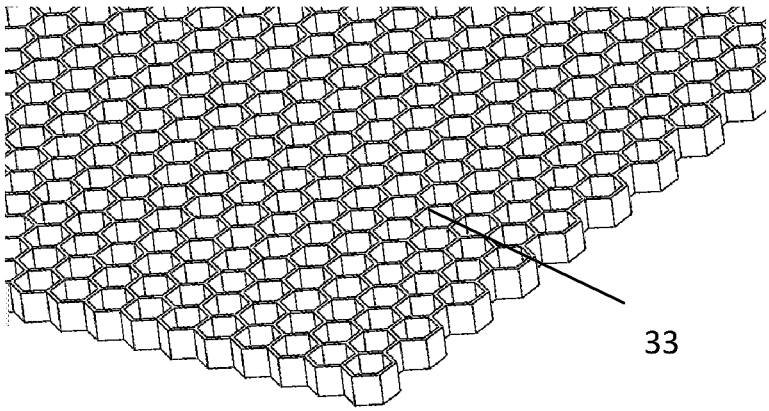
Figure 12A:
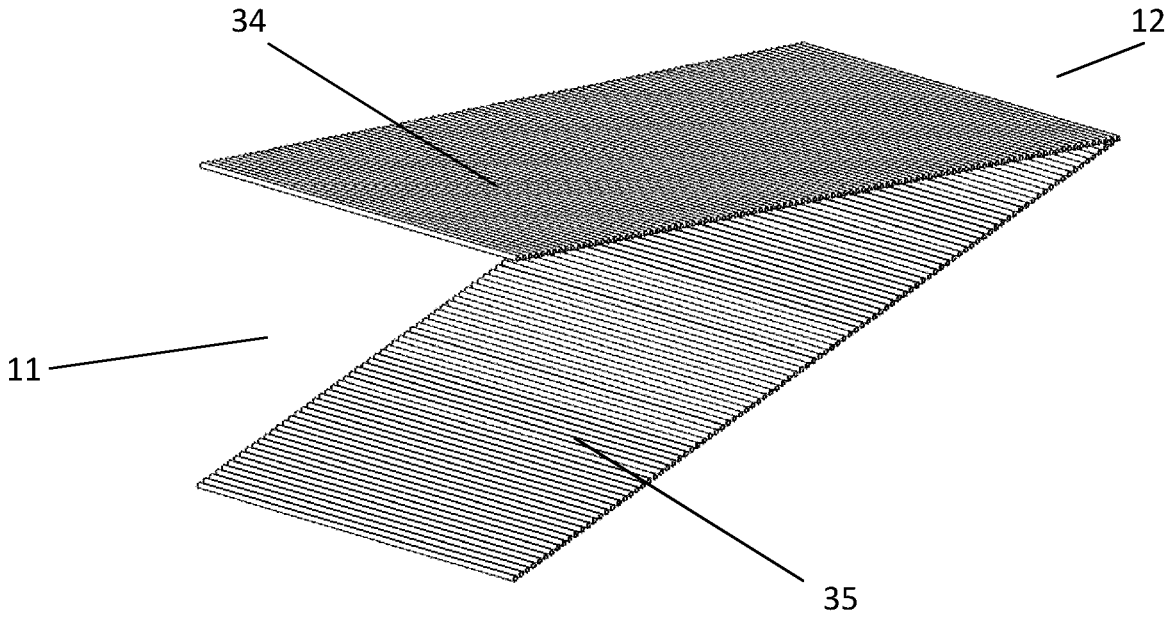
FIGS. 12*a* and 12*b* illustrate a second alternate configuration of the catalytic panels.
Figure 12B:
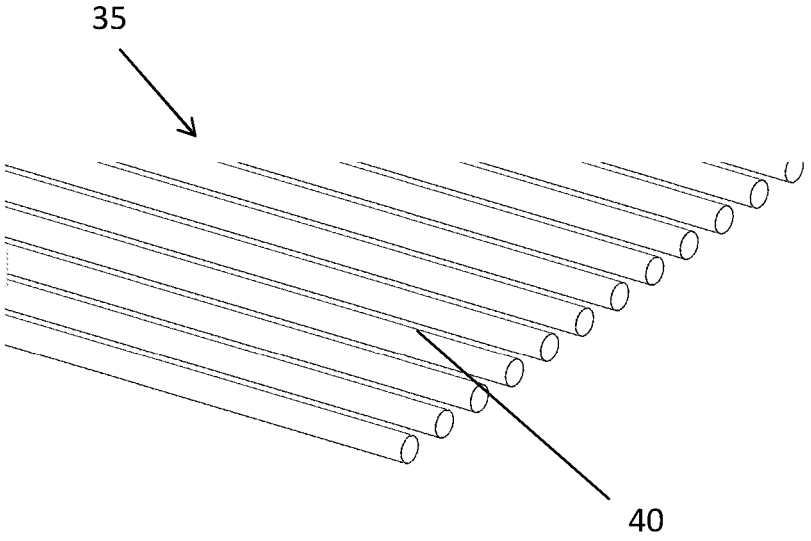

FIGS. 11*a* and 11*b* disclose an alternate embodiment of catalytic convertor panels. In this alternate embodiment, a plurality of hexagonal elements are utilized to form upper 32 and lower 33 honeycomb panels. FIGS. 12*a* and 12*b* illustrate yet another embodiment, this one having an upper panel 34 and a lower panel 35 utilizing cylindrical rod elements 40 to create the desired flow pattern. It will be readily apparent to those skilled in the art that many other configurations of the elements used to form the catalytic panels used in the convertor could be deployed to obtain similar results.

The technology disclosed herein addresses improved configurations for catalytic convertors. The improvements disclosed are independent of the actual catalytic material used for the catalytic conversion. There are a myriad of choices that would suffice as the material from which to form the catalytic panels described. Porous metal, screens, fiberglass, or porous ceramic materials could be deployed to create a catalytic panel embodying the teachings of this disclosure—keeping the boundary layer to a minimum while facilitating virgin harmful gases being brought into contact with the catalytic surfaces. Further, the type of material used to create the catalytic panels is not limited to ceramics or metals. Glass or other materials that can withstand high operating temperatures could also be deployed. Panels with square or round holes—indeed openings of nearly any conformation—could as well be deployed. It should be noted that in general, smaller panel openings, smaller pitch, and thinner thickness of material deliver improved performance. Thinner material typically leads to less mass in the device. Less mass relates to lower weight, cost of manufacturing, and faster warmup of the catalytic surfaces. Smaller pores with smaller pitch results in lower overall velocity between the pores which lead to greater conversion rates. It should be self-evident that one skilled in the art of catalytic materials could engineer a specific catalytic material to be used for catalytic convertor to be used in a given application.

Figure 13:
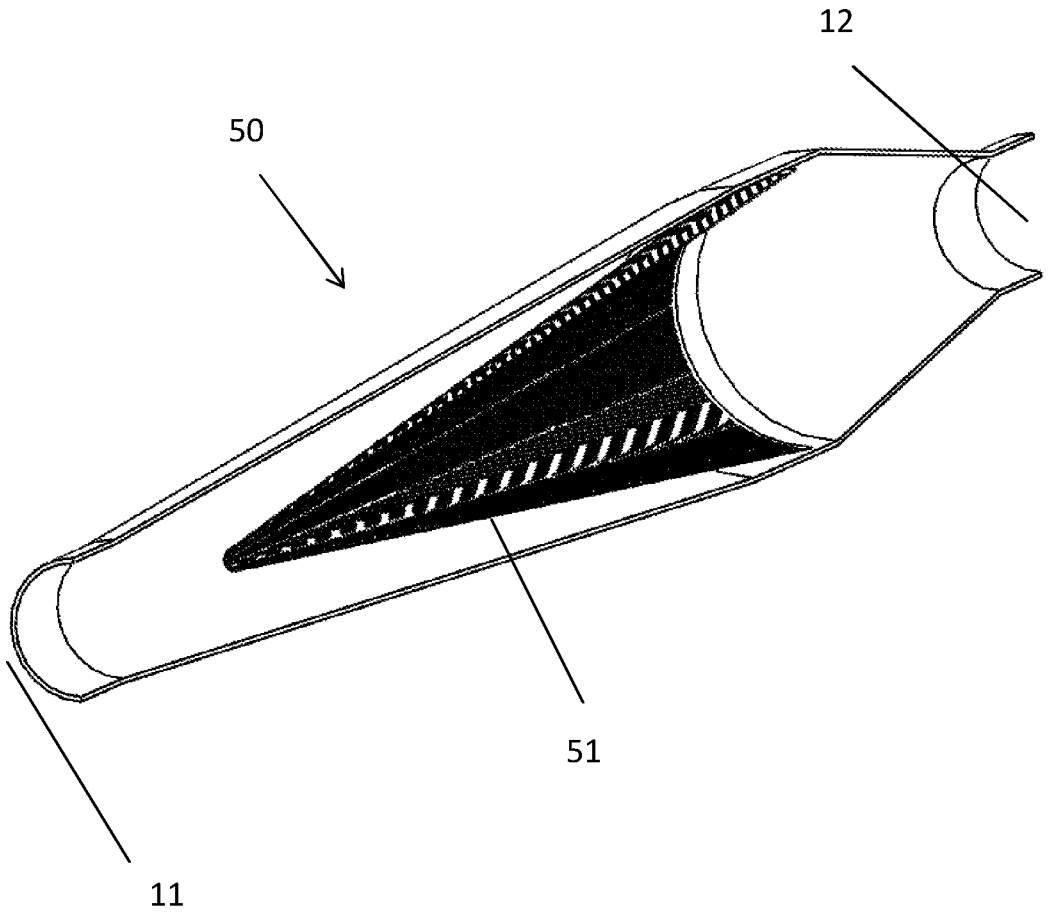
FIG. 13 is a partially broken perspective view of an alternate conical configuration of a catalytic converter.

FIG. 13 illustrates an alternate configuration of the housing and a catalytic panel 51 of a catalytic convertor 50. In this embodiment, the catalytic panel 51 is conical in shape. The overall operation and function of the conical catalytic converter 50 is the same in principle as the previously disclosed catalytic converters. In the embodiment illustrated, the tip (base of the "V" shape) of the cone is at the inlet section 11 of the catalytic converter 50 rather than at the outlet end 12. It should be noted that the orientation of the conical catalytic panel 51 would be determined by the engineering requirements of a given implementation.

Figure 14A:
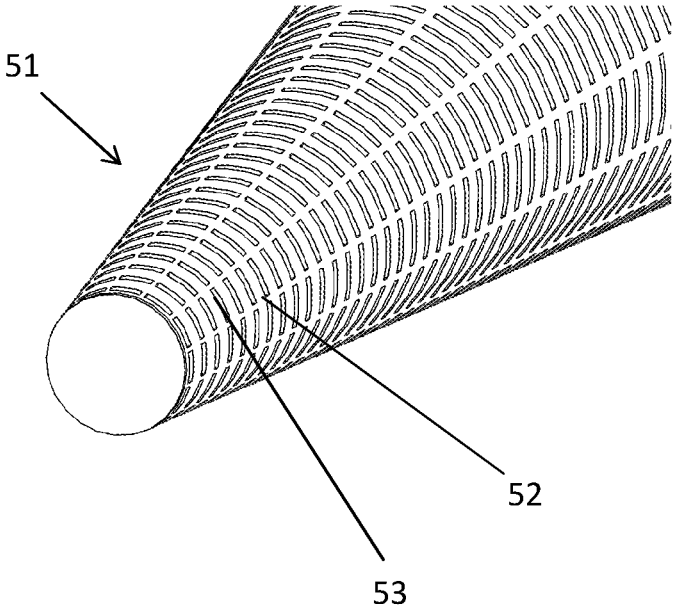
FIGS. 14*a* and 14*b* show a detail view of a small section of the conical configuration of the catalytic panel shown in FIG. 13.
Figure 14B:
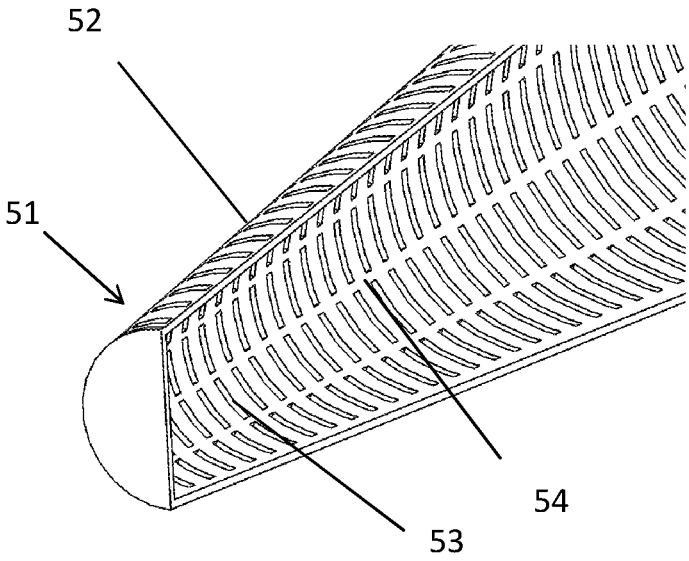

FIGS. 14*a* and 14*b* are detail views of the conical catalytic panel 51. Exhaust gases flow over the conical catalytic surfaces 52 of the conical catalytic panel 51 and are extracted through panel openings 53. The entire surface of the conical catalytic panel 51 is populated with panel openings 53.

Figure 15:
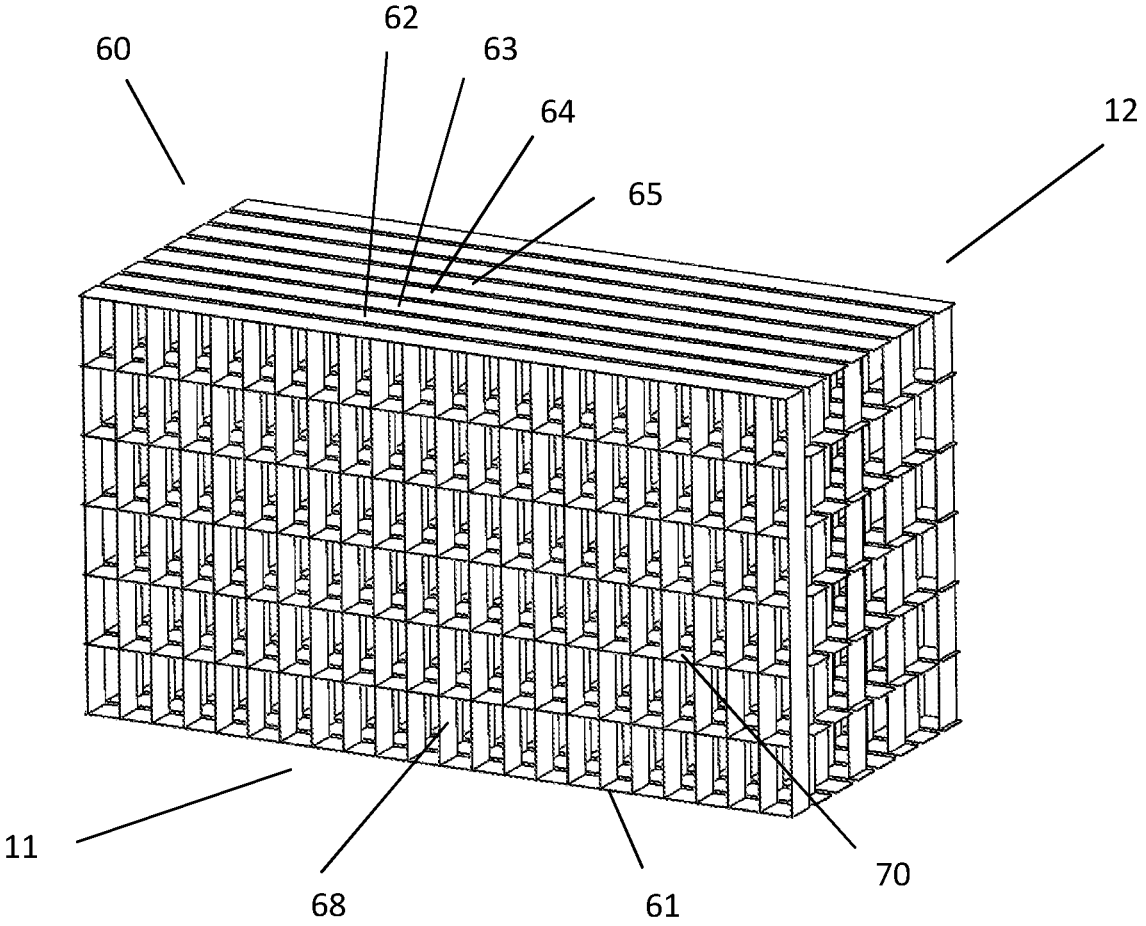
FIG. 15 is a perspective view of another alternate configuration of catalytic panels, a layered catalytic array.

FIG. 15 shows another embodiment of a catalytic convertor utilizing an alternate configuration with multiple catalytic panels 61-65. In the embodiment illustrated, the panels and the openings therein are depicted as being rectangular. It should be apparent to those skilled in the art that other geometric configurations for both the panels and the openings could also be utilized in a catalytic convertor according to the present invention. The exhaust gases enter a layered catalytic array 60 at the front surface and flow through a plurality of fluidic catalytic panels 61-65.

Figure 16:
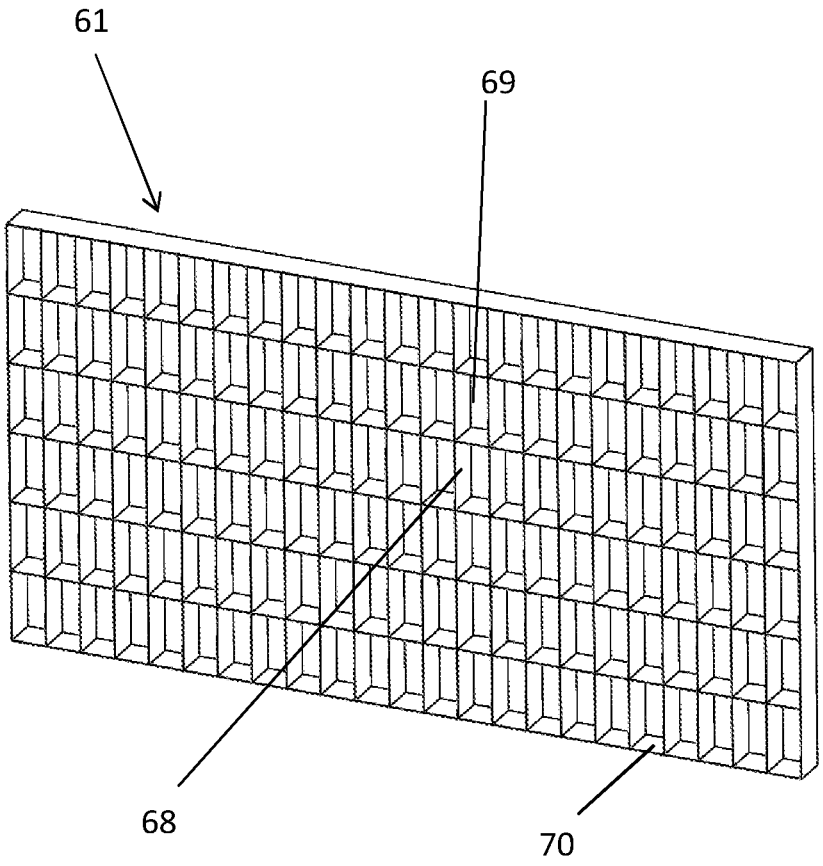
FIG. 16 is an illustration of a representative structure of one of the differing catalytic panels shown in FIG. 15.

FIG. 16 illustrates the 1st rectangular fluidic panel 61. The 1st rectangular fluidic panel 61 is constructed with a plurality of openings 69 that are formed from vertical catalytic walls 68 that constitute the sides of the openings 69, and from horizontal catalytic walls 70 that form the top and the bottom of the openings 69. The rectangular openings 69 are not drawn to scale. The openings 69 would likely be much smaller than illustrated, perhaps 2 mm wide by 2 mm tall and 2 mm deep.

Figure 17:
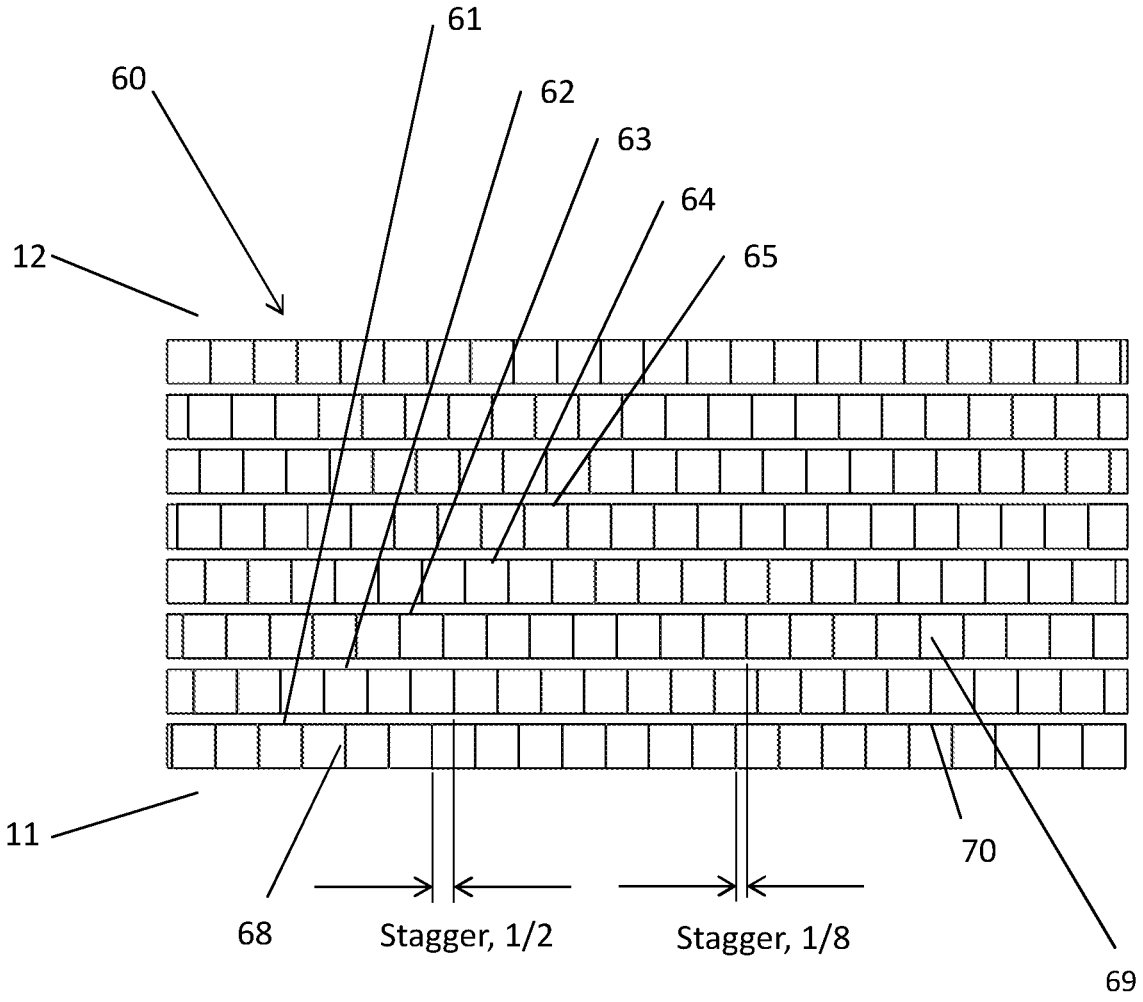
FIG. 17 is a top view of the layered catalytic array illustrated in FIG. 15, exposing the interior elements of the alternately layered catalytic array.

FIG. 17 is a top view of the layered catalytic array 60. Exhaust gases enter the array 60 via the 1st rectangular fluidic panel 61. Catalytic conversion occurs at both the horizontal catalytic walls 70 and the vertical catalytic walls 68. The exhaust gases then flow to the second rectangular fluidic panel 62. The vertical catalytic walls 68 of the second rectangular fluidic panel 62 are offset from the vertical catalytic walls 68 of the first rectangular fluidic panel 61. While any offset will have the desired effect of influencing the fluid flow pattern, in the embodiment illustrated in FIG. 17, the vertical walls 68 are offset half the width of the openings 69. The third fluidic panel 63 is similarly offset from the preceding panels. In the embodiment illustrated, the offset is ⅛ the width of the openings 69. The openings 69 of the fourth fluidic panel 64 and the fifth fluidic panel 65 are also offset from at least the immediately preceding panel. Other schemes and patterns of staggering the vertical walls 68—and consequently the openings 69—could be readily deployed. Similarly, the horizontal catalytic walls 70 may be staggered as well. The actual alignment scheme chosen would be a result of engineering considerations including the cost, fluidic performance, catalytic performance, and the warmup performance of a particular application.

Figure 18A:
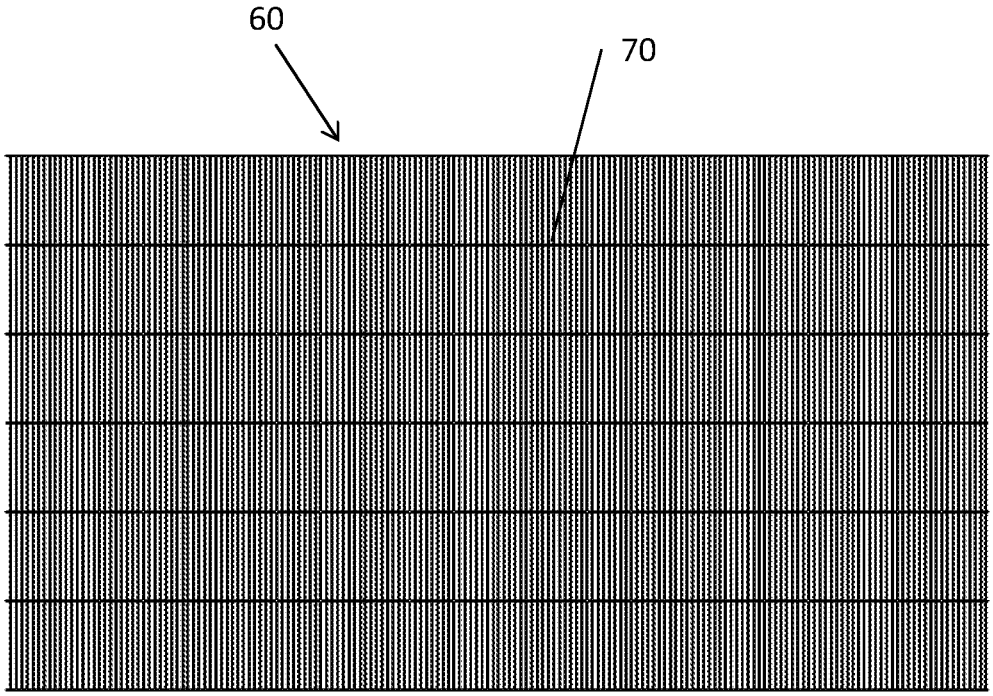
FIGS. 18*a* and 18*b* are a front view of the layered catalytic panel shown in FIG. 15 and a detailed sectional view, respectively.
Figure 18B:
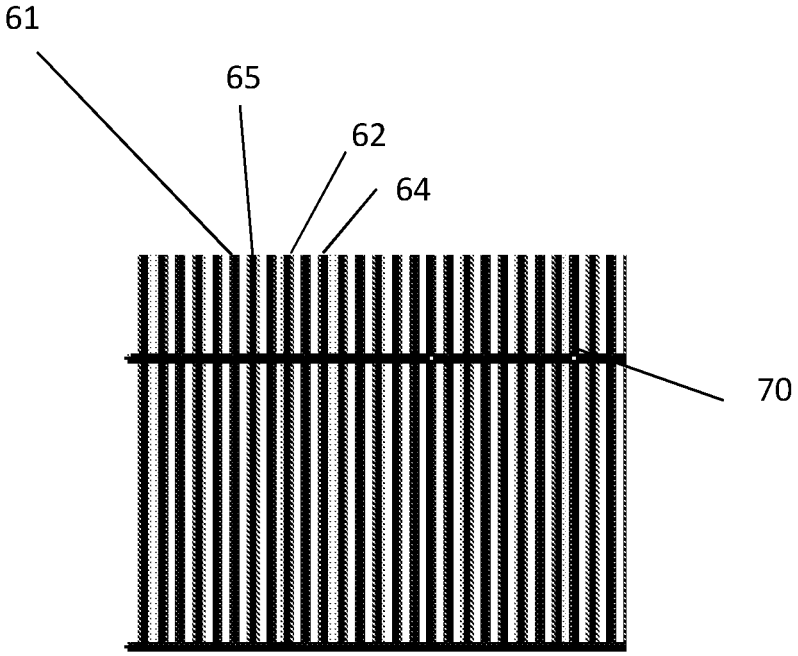

FIG. 18*a* is a front view of a layered catalytic panel 60, and FIG. 18*b* is a detailed view of a segment of the panel 60.

Figure 19:
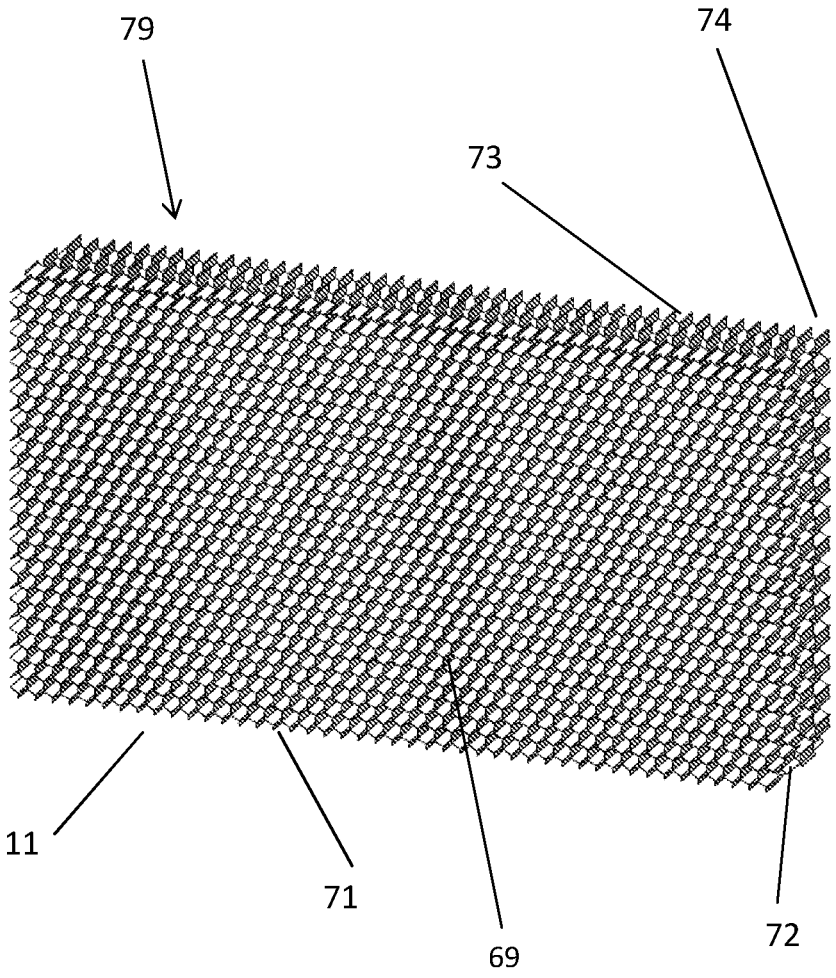
FIG. 19 is a perspective view of another alternate configuration of catalytic panels.
Figure 20A:
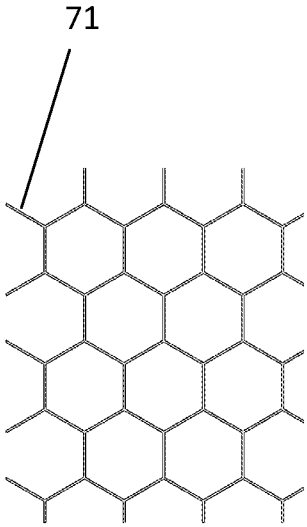
FIGS. 20*a*, 20*b*, 20*c* and 20*d* are front section views of FIG. 19 with various layers shown in sequence.
Figure 20B:
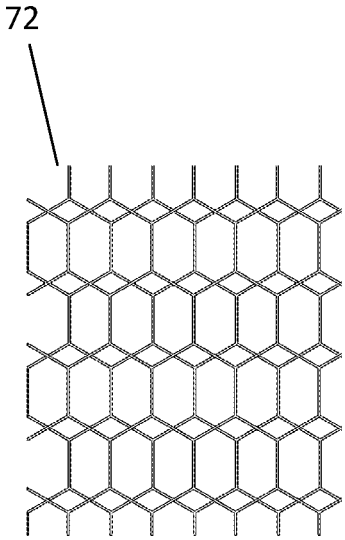
Figure 20C:
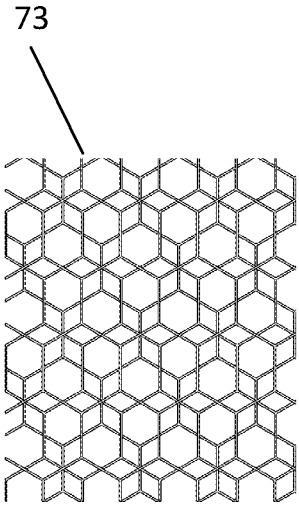
Figure 20D:
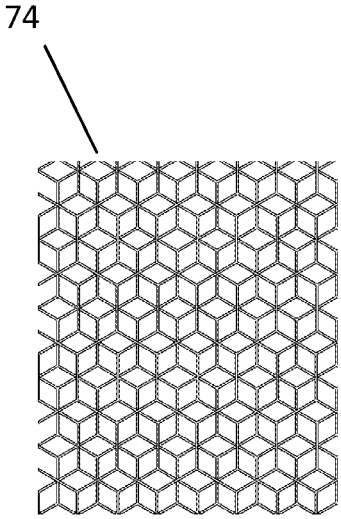

FIG. 19 illustrates a conformation of another layered catalytic array. In the embodiment depicted, the openings 69 are hexagonal so that each panel has a honeycomb configuration. FIG. 20*a* shows a view along the flow path of the catalytic convertor with a first panel 71 in the flow path. FIG. 20*b* shows the view as it would appear with a second panel 72 added to the flow path. FIGS. 20*c* and 20*d* show the array with a third panel 73 and a fourth panel 74 added to the array. Note that in addition to the horizontal offset of the openings in the panels, the panels are positioned so that there is a vertical offset in the openings as well. Each of the embodiments described and shown herein can make use of both the horizontal and vertical offsets to improve the performance of the convertor. Whatever pattern causes the harmful gas to be directed to the catalytic surfaces will improve the performance of the device. Again, keeping the boundary layer to a minimum and directing the harmful gas to multiple catalytic surfaces so that virgin gas contacts the surfaces will improve the performance of the device.

Figure 21:
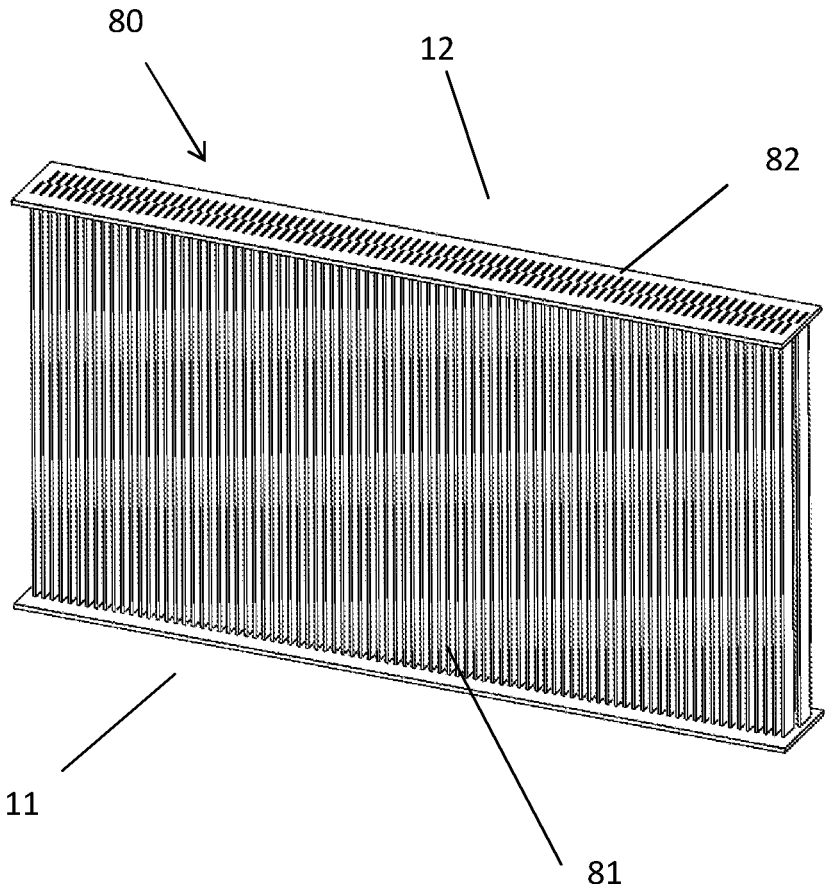
FIG. 21 is a perspective view of still another alternate configuration of the catalytic panels.
Figure 22:
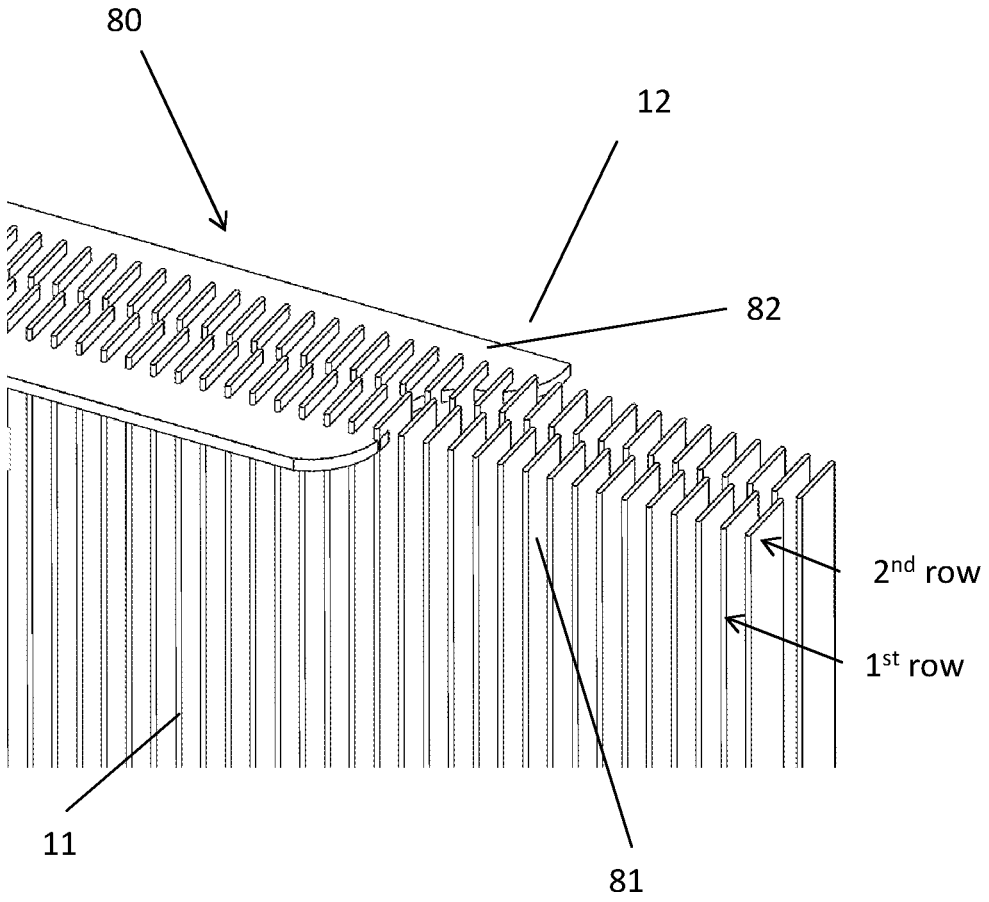
FIG. 22 is detail view of FIG. 21.

Referring now to FIG. 21, another variation of a layered catalytic panel is shown, termed a linear catalytic converter 80. This embodiment discloses still another way to mechanically create staggered fluidic panels. The detail view of FIG. 22 shows that a blade retainer 82 is used to hold a plurality of catalytic blades 81 in a staggered conformation. The blades 81 are held in position by the blade retainer 82 so that the openings in a first blade 81 are staggered from the openings in a second blade 81 in the linear catalytic convertor 80.

Figure 23:
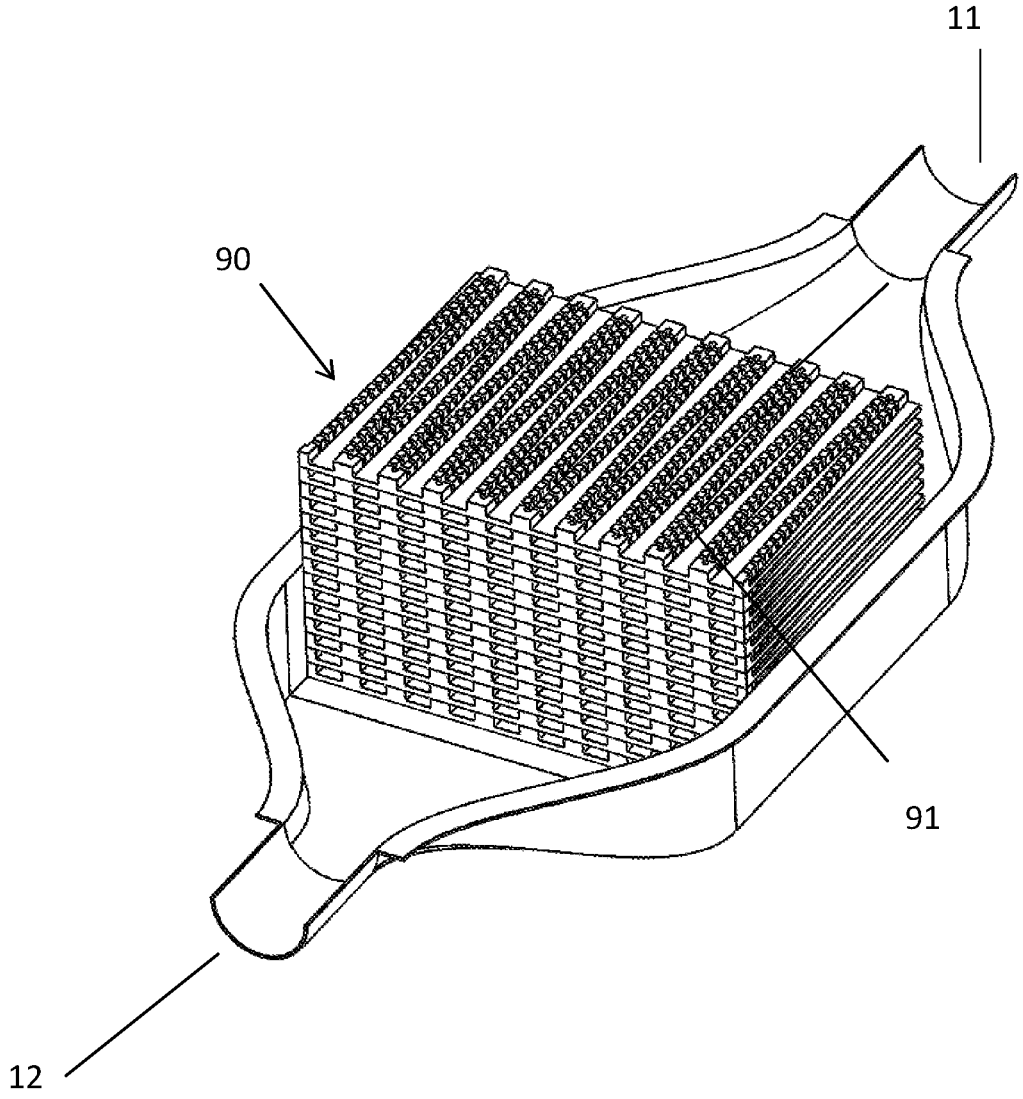
FIG. 23 is yet another alternate configuration of staggered catalytic surfaces.

FIG. 23 shows still another variation, a zigzag catalytic core 90. In this configuration, the catalytic panels 91 are arranged in a zigzag pattern. The zigzag pattern of the panels 91 allow the overall length of the catalytic convertor housing to be substantially reduced in length, while maintaining an equivalent amount of panel surface area as in the configurations utilizing straight line patterns for the panels.

Figure 24:
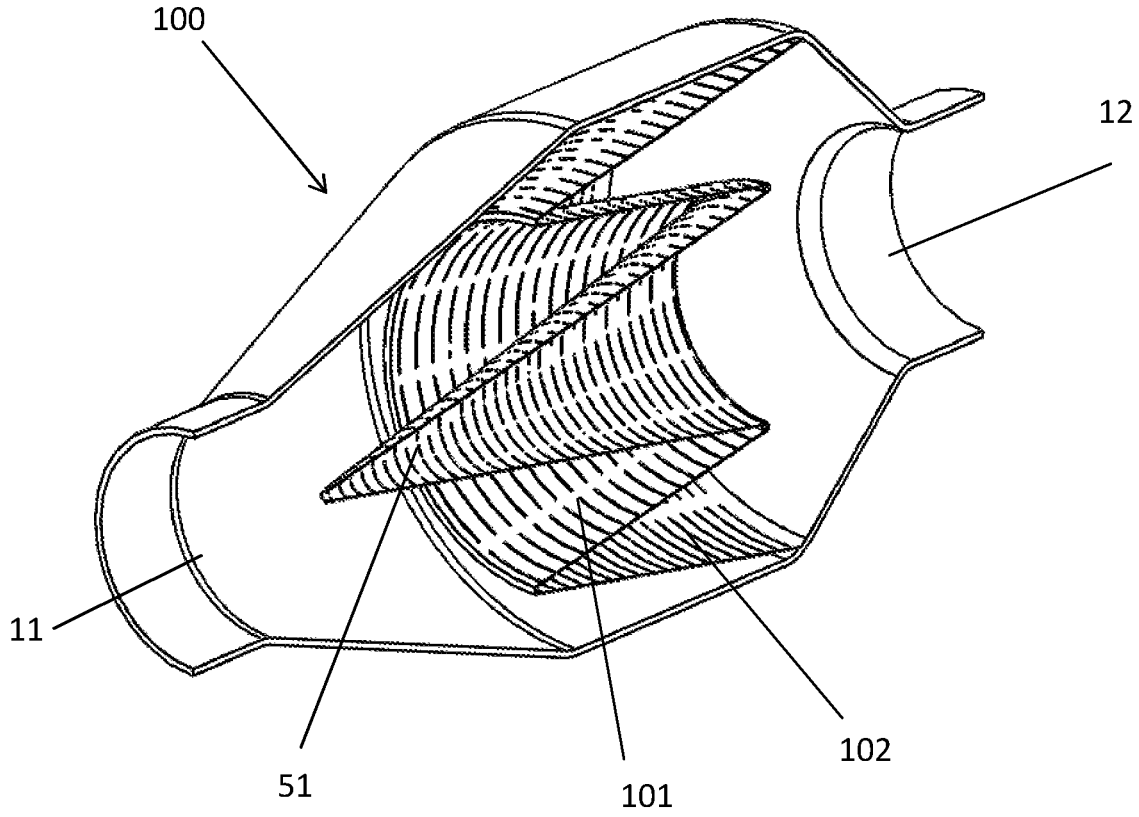
FIG. 24 is still another alternate configuration of staggered catalytic surfaces.

FIG. 24 shows the principal of a zigzag configuration as applied to the conical catalytic converter disclosed in FIG. 13. In FIG. 24, the conical catalytic panel 51 is folded back onto itself at the juncture of conical panel 51 and a first zigzag conical panel 101. Conical plane 101 then folds again to extend to a second conical panel 102. The zigzag configuration allows the convertor to have more catalytic surface in a given length of housing.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

The terminology used herein is for the purpose of describing particular embodiments only and is not intended to be limiting of the technology. As used herein, the singular forms "a", "an" and "the" are intended to include the plural forms as well, unless the context clearly indicates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present disclosure. As such, some of the components may have been distorted from their actual scale for pictorial clarity.

In the foregoing description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

Also, some embodiments may be described in terms of "means for" performing a task or set of tasks. It will be understood that a "means for" may be expressed herein in terms of a structure, such as a processor, a memory, an I/O device such as a camera, or combinations thereof. Alternatively, the "means for" may include an algorithm that is descriptive of a function or method step, while in yet other embodiments the "means for" is expressed in terms of a mathematical formula, prose, or as a flow chart or signal diagram.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. A catalytic convertor device, comprising:

a housing; and a convertor core comprising at least one catalytic panel having a surface coated with a catalytic material, the convertor core and the housing each comprising an inlet side and an outlet side, the at least one catalytic panel comprising openings that form fluid flow paths, the openings being staggered from the inlet side to the outlet side so that no fluid flow path is a straight line, wherein the openings are pass-through openings made in the at least one catalytic panel.

2. The device according to claim 1, wherein at least a first and a second catalytic panel are utilized, the first and second catalytic panels each being attached at a first end to a top of the inlet side, and being attached at a second end to the second end of the other catalytic panel.

3. The device according to claim 2, wherein each of the catalytic panels comprises a plurality of panel sections separated by openings that form flow path channels, the openings being staggered so that a flow path of the gas passing through the device cannot be a straight line.

4. The device according to claim 2, wherein adjacent ones of the panel sections are secured in position by at least one panel connecting member.

5. The device according to claim 2, wherein each of the catalytic panels comprises a plurality of polygonal shaped openings that form flow path channels.

6. The device according to claim 2, wherein each of the catalytic panels is formed from spaced apart cylindrical rod elements.

7. The device according to claim 1, wherein the at least one catalytic panel comprises a plurality of panel sections separated by openings that form flow path channels, the openings being staggered so that a flow path of the gas passing through the device cannot be a straight line.

8. The device according to claim 1, wherein adjacent ones of the panel sections are secured in position by at least one panel connecting member.

9. The device according to claim 1, wherein the at least one catalytic panel comprises a plurality of polygonal shaped openings that form flow path channels.

10. The device according to claim 1, wherein the at least one catalytic panel is formed from spaced apart cylindrical rod elements.

* * * * *